United States Patent [19]

Munz, deceased

[11] Patent Number: 4,635,618

[45] Date of Patent: Jan. 13, 1987

[54] SKIN LIFTING DEVICE FOR BODY EXERCISING PURPOSES

[76] Inventor: Otto J. Munz, deceased, late of 600 S. 22nd St., Arlington, Va. 22202, Gerta H. Munz, executrix

[21] Appl. No.: 870,731

[22] Filed: Jan. 19, 1978

[51] Int. Cl.[4] ..... A61H 1/00

[52] U.S. Cl. ..... 128/24 R; 128/67

[58] Field of Search ..... 128/276, 297, 299, 368, 128/281, 282, 24 R, 67, 399, 401, 402, 24, 2, 300, 278; 119/100, 102, 14.47, 14.48, 14.49, 14.5, 14.51, 14.52, 14.53, 14.54, 14.55; 272/DIG. 4; 604/313, 316

[56] References Cited

U.S. PATENT DOCUMENTS 655,747 8/1900 Winckfield ..... 128/300

FOREIGN PATENT DOCUMENTS 2232694 10/1973 Fed. Rep. of Germany ..... 128/278

*Primary Examiner*—C. Fred Rosenbaum

*Assistant Examiner*—J. L. Kruter

[57] ABSTRACT

A skin raising suction device to maintain the skin with its underlying strata automatically lifted and stretched above the rest of the body has a hard cylinder, a piston-type dome and a bulging elastic belt integrally connecting the upper rims of the cylinder and dome, the cylinder having a frusto-conical inner wall narrowing toward its bottom to about the diameter of the dome; the belt having a volume and a resilient capacity to permit pushing it within the cylinder on depression of the dome together with it toward the bottom of the cylinder and the skin and a dynamic elastic memory and strength to lift automatically the dome with the skin and connecting tissues away from the body into the cylinder after release of the compression.

1 Claim, 6 Drawing Figures

SKIN LIFTING DEVICE FOR BODY EXERCISING PURPOSES

FIELD OF ART

An exercising device and method for stretching, lifting and suspending human skin with the underlying connecting tissues and attached strata from the solid body portion.

DESCRIPTION OF THE PRIOR ART

Manual means are conventionally being used to push the skin against the body. There are no devices in the prior art which would suspend the skin with its substrata away from the solid body either automatically by employing a vacuum, or in addition by mechanical means.

The prior art is represented by U.S. Pat. No. 2,879,765 to Featherston, of Mar. 1959 for a "Therapeutic Device Employing A Bell-Shaped Type Flexible Suction Cup" having a wide diameter bottom and narrowing toward the top to a point of an air vent.

The suction cup is shaped to adhere to the human head and permits adhesion by compressive air-evacuation, does not, however, provide for a simultaneous automatic skin lifting effect without manipulation of the handle.

The suction cup has a flexible wall. On compression with the skin its rim spreads outwardly, simultaneously pushing and stretching the skin from underneath the cup outwardly.

The inside shape of the hemispheric cup being elastic, it buckles outwardly leaving air pockets within and does not provide additional evacuated space into which the skin could be lifted.

Therefore a compression produces only adhesion of the cup to the head, the volume of the incomplete vacuum being filled by the skull. An automatic lifting of the skin with the underlying strata into the cup and holding it there suspended for an extended period of time is not provided for. Numeroud other suction cups of the prior art are designed for adherence to rigid surfaces of objects to lift the objects or to use the objects as supports for the cups to be employed as holders, hangers and similar. They have elastic hemispheric or cone type bodies subject to distortion and contraction under a load. The rims of the cups, if used on skin, would expand and stretch the skin without causing a positive pull on it, instead of lifting it.

SUMMARY OF THE INVENTION

For purposes of this disclosure "skin" includes a flexible, amorphous, or resilient surface, or layer, including any yielding or resilient interconnected tissues and underlying strata and their normally inaccessible extensions such as those of human skin reaching under the ribs, pelvis, spine and hips, including fatty subcutaneous tissues, parts of male and female organs, kidnes, intestines, the prostate glands, liver, bladder, gall bladder, nerve fiber, muscles, flesh, blood vessels, ligaments cartilage, sinews and membranes.

The terms "top", "upper", "lower", "horizontal", etc. are used for pointing out the invention as it appears upon the figures and are not to be interpreted as limiting the use of the device to any particular angular position with respect to the vertical.

The solid or rigid non-elastic suction cylinder of the present invention is designed for contact with the elastic human skin with the object of creating by elastodynamic suction for an extended period of time a positive pull on the skin, overcoming its tension and forcing expansion of the skin, at least partly followed by the connected underlying strata from their conventional locations away from the solid body into and toward the cylinder, respectively.

Other objects of the invention are:

to provide a device and method of treating the human body for health purposes by pulling and pushing the lifted skin controllably into various directions, by subjecting the lifted skin to controlled thermal treatments, and by employing controlled automatic programming therefore;

to provide a skin lifting and pulling device of minimum necessary dimensions and weight fully utilizing its volume, with a maximum lifting efficiency and having a thin and flat shape to permit for instance the body to lie on it, such as in sleep for an extended period of time, without bleeding the vacuum;

to provide a solid cylinder with a piston-type rigid planar dome interconnected by a swelled elastic belt, which on compression of the dome against the skin biases the dome in the cylinder for an automatic return, simultaneously causing air-tight sealing of the cylinder against the skin, whereby the return pull of the belt overcomes the skin resistance and lifts the skin into the cylinder;

to provide the suction cylinder with means to control the size of the cavity and the amount of skin permitted to be sucked thereinto; and to provide a package with a plurality of suction devices in an assortment of several sizes and shapes, scaled to the conventional sizes of the bodies and the areas to be treated, including devices having cylinders with circular squarish, oblong and elongated bottom rims and three-dimensionally curved rims with means to circulate a temperature controlled evacuation of fluid in thermal contact with the skin and to evacuate and vent said devices and with means to reciprocate the lifted skin in controlled directions three-dimensionally.

The lifting and suspension of the skin may be arranged to be temporary, intermittent or constant such as for a few minutes or hours, or at timed intervals to produce often an almost instantaneous beneficial effect upon the person who suffers with back pain, arthritis, and muscle pain, such as caused by impact, non-use of muscles, muscle strain or by inflammations of muscles and nerves caused by cold or draft, or to prevent or correct adhesions, or to hold cut skin during a surgical operation out of the way or suspended during a medical examination.

The device is suitable also for reciprocating lifting of the ribs to aid the functions of lungs and heart.

Other objects and advantages of the invention will become apparent to those skilled in the art from the following description and drawings:

Figure 1:
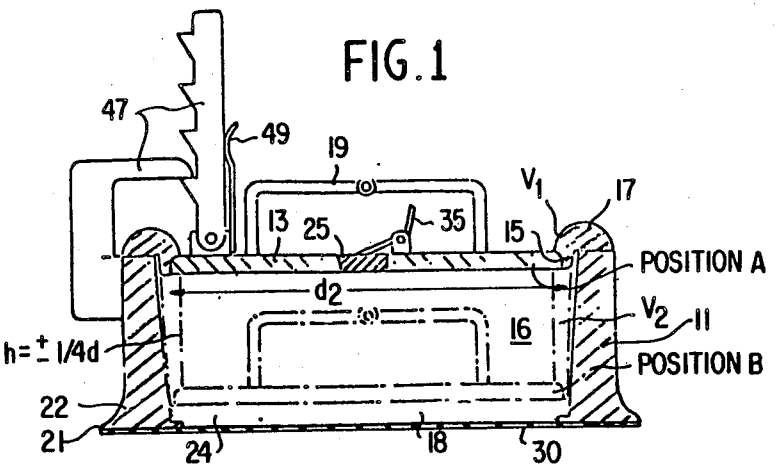
FIG. 1 is a cross-sectional view of a basic unit of the device of the invention and depicts also additional optional improvements.

The optional improvements depicted on the several figures may be added to the basic device selectively or cumulatively and repetitions are omitted from the various figures for purposes of brevity.

The same reference numerals denote the same or equivalent parts throughout the several figures of drawings.

DESCRIPTION OF THE PREFERRED EMBODIMENTS

The suction cylinder as shown on FIG. 1 in its simplest form comprises a rigid cylinder wall 11 having a dome 13, and an elastic belt 15 integrally connected with the adjacent rims of the cylinder and dome.

The belt has a swelling 17, with a volume $V_1$ extending outwardly, such as above the top of the dome when the latter is in neutral position "A". On depression by dome-depression means 19 such as a handle, after the cylinder has been placed with its lower hard rim 22 against the elastic skin 23, the dome is pushed downward into a depressed position "B". Simultaneously the swelling $V_1$ by its dynamic elasticity is stretched downwardly and distributed adjacent the interior wall of the cylinder as volume $V_2$ as it follows the movement of the dome. The bottom of the dome travels a distance $h=\frac{1}{4}\pm$ of its diameter "d" to the hard rim of the cylinder at its diameter "$d_1$", whereby it stretches the belt for a return pull of the dome and lifting of the skin 23.

The depression of the dome causes expulsions of the air between the rim 21 of the cylinder and the adjacent skin.

Optionally a source of vacuum 63, such as a manually applicable suction balloon or vacuum pump is connected to a valve 25 in lieu of the handle.

Optionally or in addition to the source the valve 25 is shown located in the dome, but not limited to such location. The valve may be located, for instance, in the belt or cylinder. Preferably the upper inner diameter "$d_2$" of the cylinder at the junction of its rim with the belt decreases downwardly in proportion with the decrease in the thickness of the streched belt to "$d_1$" shaping the interior wall of the cylinder into a truncated cone.

For odd shaped body surfaces such as the shoulders, head, the spinal regions, the hips and the knee-caps and similar, the cross-sections and hard rims of the cylinders normally planar are correspondingly shaped, such as to be circular, square preferably with rounded corners, oblong, and/or three-dimensionally curved, or as hemitoroids.

Figure 4:
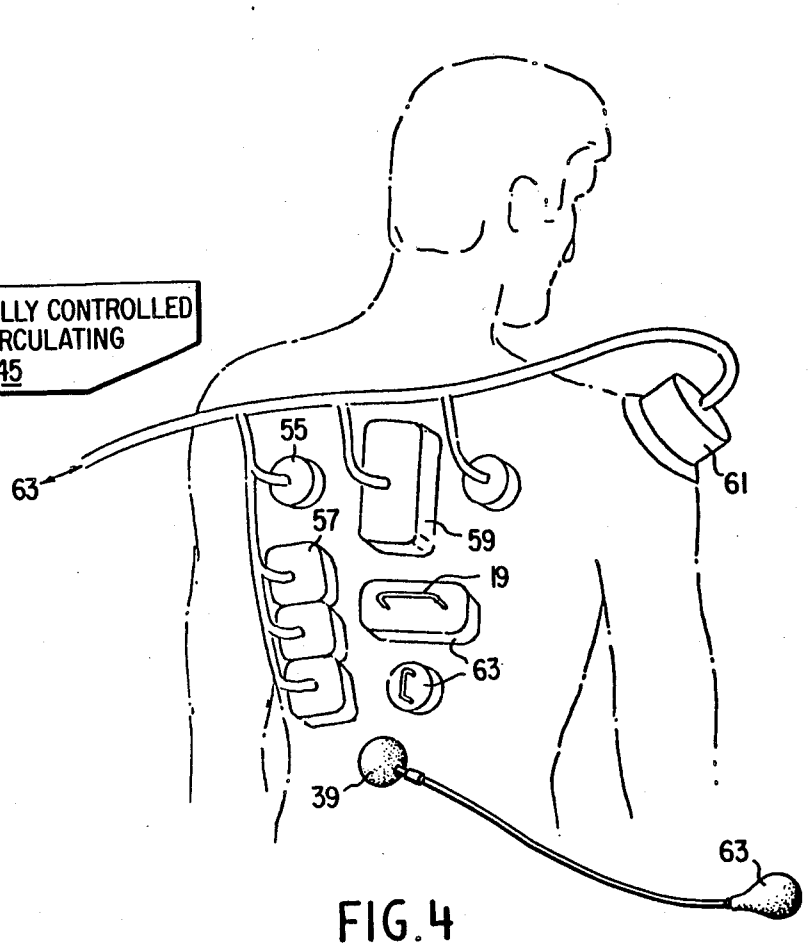
FIG. 4 is a perspective view of an exemplary assembly of differently shaped devices and parts of the invention shown on FIG. 1 in operational contact with the back of a human body.

As an example there are shown on FIG. 4 a circular cylinder 55, a part of an assembly 57 of squarish cylinders with rounded corners, oblong cylinders 59 and a cylinder 61 having a curved three-dimensional rim.

As an example on FIG. 4 a plurality of the cylinders 55, 57, 59 and 61 represent a package in assembly with flexible conduit connections with a common source of vacuum while some cylinders are shown placed manually.

Since different human bodies and skin areas have different degrees of stretchability and tension, different plastics have different moduli of elasticity and the volumes of the cylinders vary, the volumes of the swellings of the belt also vary and are also different for cylinders which are to cover differently sized and shaped areas of the skin. Therefore, for purposes of assembling an overall useful package of variagated cylinders for uses such as shown on FIGS. 4 and 5, the cavities and volumes of the swellings of a plurality of cylinders of various sizes and shapes are provided scaled to enable the operator to select such, he considers best from case to case for the varying dynamic pulls required to overcome different resistances of the particular skin areas to be treated.

Figure 3:
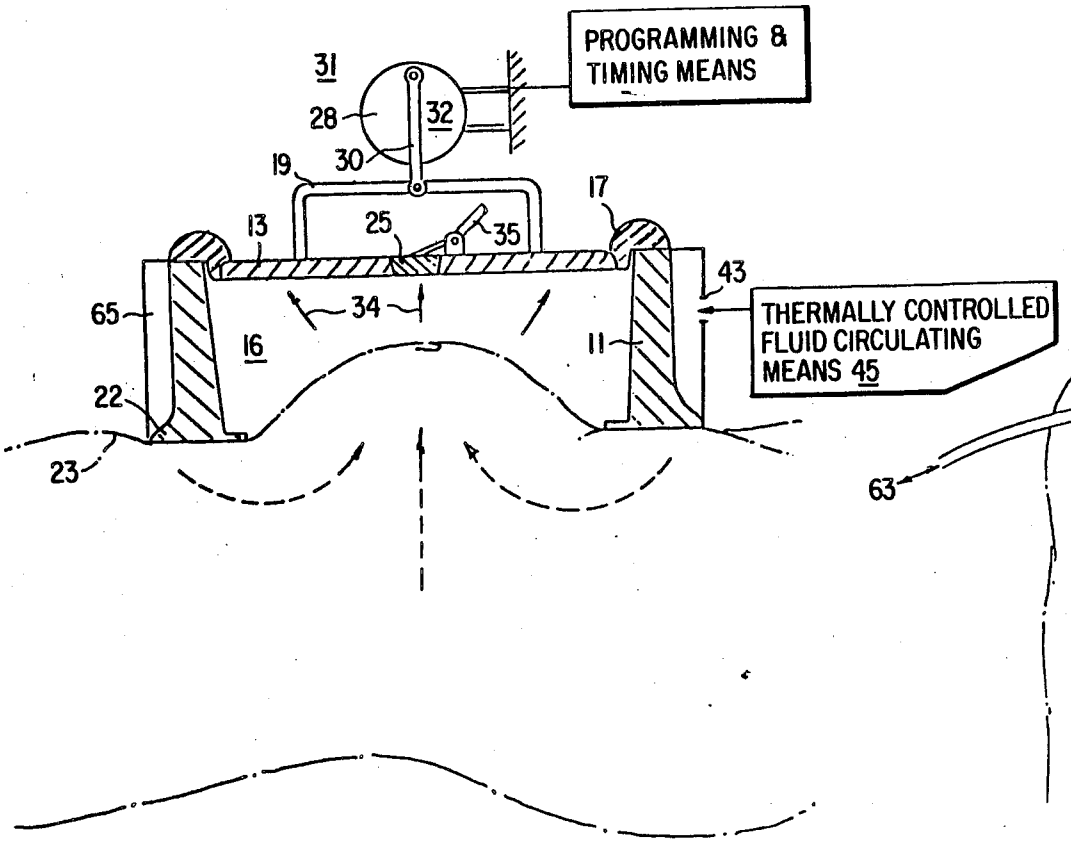
FIG. 3 is a view of the basic device shown on FIGS. 1 and 2 including additional optional improvements and together with an exemplary diagrammatic cross-sectional view of the human abdomen in operational contact with the device of the invention.

For practical purposes useful proportions of the cylinder and of the volume of the resilient belt described are established experimentally to indicate approximately to scale as shown in examples on FIGS. 1, 3 and 4, the height "h" of the cylinder to be approximately equal to between $\frac{1}{4}\pm$ to $\frac{1}{2}\pm$ of the diameter "d" of the dome at about 1" to 6"± of the diameter "$d_1$" of the cylinder when the belt with its swelling $V_1$ have a rapid total elastic memory at a few seconds at a temperature of about 96° Fahrenheit ± with a compression deflection of the belt volume of about 5 lbs to 20 lbs.

The formula $h=\frac{1}{4}\pm$ of "d" is predicated on the anatomy of an average human body. Soft portions thereof, such as the abdomen and the hips present larger areas of skin, such as up to 10"± for the abdomen, which it may be desirable to lift to considerable heights, such as to a $2\frac{1}{2}$" skin lift without damage to the abdomen. The tight skin areas on the hard portions of the body, such as over the spine can not be lifted by large area suction devices because of the unevennesses of the surface. Thus a plurality of small diameter suction devices is employed, such as h=1"± permitting lifting of the skin only about $\frac{1}{4}$"—without damage thereto.

The operator makes the decision in each case which size and type of cylinder to use and as the treatments are repeated he will use a cylinder with a greater "h" and/or higher compression deflection for progressively stronger evacuation.

For this reason to permit a graduated scaling of the evacuation of the cylinder, optional dome depression control means are shown on FIG. 1, as conventional ratchet means 47 attached to the cylinder and dome in mating relationship, together with means 49 to release the ratchet shown as a manually operable spring. Preferably a 1/16± inch tacky amorphous rubbery surface 21 having a Shore Hardness at 96° Fahrenheit ± of about 1 with a compression deflection at about 1 lb ± is provided on the hard bottom rim 22 to insure an airtight seal over any follicles and unevennsess of skin.

Figure 5:
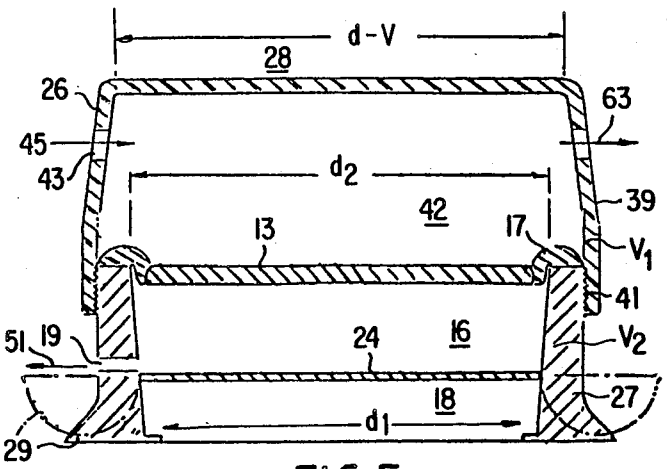
FIG. 5 depicts the basic device shown on FIG. 1 including an additional optional improvement.
Figure 6:
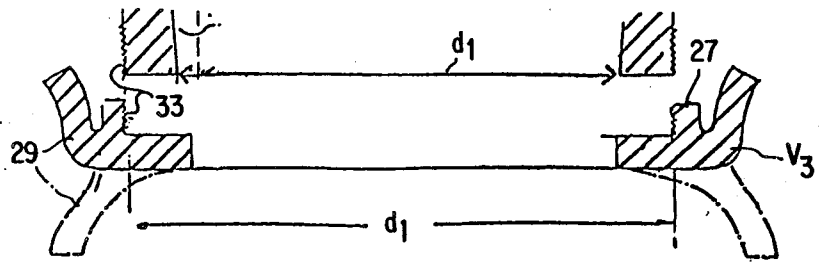
FIG. 6 is a partial view of the basic device of FIG. 1 including an additional optional improvement.

As shown on FIGS. 5 and 6 optionally the bottom rim of the cylinder is provided with an elastic band 27 extending about vertically and having an integral elastic swelled bulge 29 extending horizontally therefrom with a bottom planar surface in their respective undisturbed positions.

The volumes of the band and of the bulge $V_3$ have an elasticity and dynamic strength of recovery, permitting their manual upward biased folding over the outer wall of the bottom rim of the cylinder as indicated in phantom lines and after airtight compression of the cylinder against the skin, their springing back into their former undisturbed position while simultaneously pulling the skin adjacent to the cylinder underneath thereof in an air-tight seal.

The bulge expands in diameter while it is being stretched to be folded over the hard rim and pressed against the skin with the dome pushed down to the skin. A slight urging with the fingers of the hand thereafter flips the bulge back against the skin pushing the skin surrounding the rim into the cavity, thus further evacuating the cylinder, providing an air-tight seal with the skin and aiding in the lifting of the skin into the cylinder.

Optionally as shown on FIG. 6 the base is a separable part provided with threads 33 mating with cooperating threads of the outer bottom wall of the cylinders and providing thus means for variably spacing the bottom of the cylinder from the skin.

An improvement shown on FIG. 1 comprises an elastic diaphragm 24 connecting the area "$d_1$" of the hard rim in an air-tight engagement, thus separating the cylinder from the skin into an upper fluid flow chamber 16, optionally provided with thermally controlled fluid circulating and evacuation means 51 and a lower suction adhesion chamber 18, which on actuation of the bulge provides intimate adhesion to the skin.

Optionally a source of vacuum 63, such as a manually applicable suction balloon or vacuum pump is connected to the valve in lieu of the handle.

The handle is shown on FIG. 1 submerged into the cylinder during depression with its top about level with the planar surface of the cylinder rim so as to avoid its accidental further depression or pivoting when the person using it lies on it which otherwise could cause bleeding of the vacuum. In such an instance the ratchet means 47 as shown are omitted or relocated.

Figure 2:
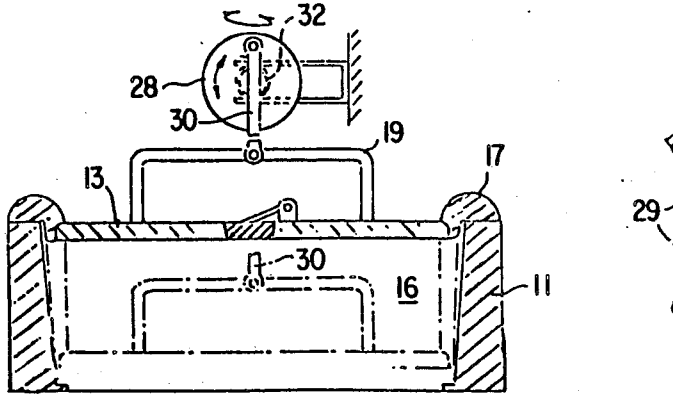
FIG. 2 depicts the basic device shown on FIG. 1, including different additional optional improvements.

As shown on FIGS. 2 and 4 optionally conventional mechanical means 28 to reciprocate the evacuated cylinder, to pivot it and to twist it, in a plurality of planes and at controlled amplitudes and intervals with programmed timing means are hooked up with the handle.

A conventional vertical gymbal suspension 31 mounted on a U-shaped bracket, hidden behind the connecting arm 30, provides reciprocation about the vertical axis, while the wheel 32 reciprocates the arm about the horizontal axis, thus lifting and lowering the device in changing directions indicated by arrows 34, simultaneously pulling and pushing the skin with the connected strata in changing directions, while the more distant and from outside inaccessible soft connected anatomy follows at least part way.

On FIG. 5 means 26 to reciprocate the dome within the cylinder are shown as comprising an upper hard cylindrical suction cup 39 with controllable spacing means 41 of airtight attachment to the outer upper wall of the cylinder.

The outer cup is connected to a separate vacuum connection exhausted by a vacuum pump. Thus two vacuum chambers are provided, one 16 of the inner cylinder connected to a vacuum and a second above it of the outer cup connected to a vacuum with a fluid flow control means 63 to lift and release the cylinder with the skin by varying the pressure in the outer cup.

The reason for this design is that a single vacuum source may operate both chambers with separate valves.

A rigid suction cup attachment 29 to the suction cup 11, without a suction cylinder, such as shown on FIG. 5, having an orifice and exhaust means 63 is as shown on FIG. 4, equally capable of performing the lifting, provided that the above described dimensional considerations are observed.

As shown on FIG. 3 the cylindrical wall of the cylinder has a jacket 65 with an orifice 43 for conduit connection with a thermally controllable source of fluid flow.

For temperature controlled fluids the adjacent portions of the cylinder are made of thermally conductive materials to exert a thermal effect upon the skin.

While the device of the invention is particularly suitable with an optimum efficiency and minimum thickness for the lifting, stretching and other type handling of elastic surfaces, it is useful also for lifting of or adherence to bodies with non-elastic hard surfaces.

The materials of the cylinder, and dome, while having a different degree of hardness from the dynamically elastic belt may be the same. such as rubber, or polyethylene. Hardness may be conventionally provided by an increased thickness and/or imbedded reinforcing stays without a substantially increased weight, and/or by curing such as by addition of carbon, irradiation and similar. The elastic memory of the belt is conventionally increased such as by imbedded spring or the selection of the appropriate material, for instance of rubber cross-linked sufficiently to overcome the resistance to pull of a given skin area. Thus an integral device comprising the cylinder, the dome and the belt may be molded in one operation.

Preferably at least portions of the cylinder are transparent to permit observation of the depth to which the skin penetrates into the cavity.

The hard cylinder elastic bulge and dome combination with its minimum size and weight provides an air-pocket-free automatic positive skin lifting and holding suction.

The invention may be practiced with a lesser efficiency also with suction cups having a hemispheric or truncated cone shape as long as the additional improvements hereinabove described are observed.

I claim:

1. A suction device comprising:

a rigid cylinder having an upper and a lower rim;

a rigid dome;

an elastomeric belt with a peripheral elastomeric swelling integrally connecting the upper rim of said cylinder with the rim of said dome;

the bottom rim of said cylinder in its normal position comprising an elastic cylindrical distal band extending about vertically and an integral elastic bulge extending horizontally therefrom in their respective normal positions;

the volumes of said distal band and of said bulge having an elasticity and dynamic strength of recovery permitting their manual upward biased folding over the outer wall of the bottom of the cylinder rim and after air-tight compression of the said cylinder rim against the skin, their springing back into their normal position, while simultaneously stretching the skin adjacent to the cylinder underneath thereof.

* * * * *